US006290619B1

(12) United States Patent
Mayer, II

(10) Patent No.: US 6,290,619 B1
(45) Date of Patent: Sep. 18, 2001

(54) BALL FOR USE IN OFF-ICE HOCKEY TRAINING ON THE STREET

(76) Inventor: Bruce Allen Mayer, II, 1131 Knox Place Dr., Apt. B, Greensboro, NC (US) 27407

( * ) Notice: Subject to any disclaimer, the term of this patent is extended or adjusted under 35 U.S.C. 154(b) by 0 days.

(21) Appl. No.: 09/514,059

(22) Filed: Feb. 25, 2000

Related U.S. Application Data

(60) Provisional application No. 60/121,368, filed on Feb. 25, 2000.

(51) Int. Cl.[7] ..... A63B 39/00
(52) U.S. Cl. ..... 473/446; 473/609
(58) Field of Search ..... 473/588, 589, 473/FOR 229, 230, 231, 422, 446, 604, 609

(56) References Cited

U.S. PATENT DOCUMENTS 4,153,253 * 5/1979 White, Sr. ..... 473/588
5,284,343 * 2/1994 Bigornia et al. ..... 473/588
5,855,528 * 1/1999 Aiello et al. ..... 473/588
5,857,925 * 1/1999 Sullivan et al. ..... 473/374
5,924,942 * 7/1999 Gentile ..... 473/570
6,099,416 * 8/2000 Sullivan et al. ..... 473/378

* cited by examiner

*Primary Examiner*—Raleigh W. Chiu
(74) *Attorney, Agent, or Firm*—Hopgood, Calimafde, Judlowe & Mondolino LLP

(57) ABSTRACT

The present invention is a street hockey ball for use in games on hard surfaces. The ball has a core of a low rebound material, and a hard, tough covering material. This invention provides for the height of contact between the ball and the stick to approximate the height of contact between the hockey puck and the stick, and the weight of the ball is likewise designed to approximate a puck. In this way the ball of the present invention simulates the feel and action of a hockey puck, for example providing ice hockey players with a viable training device off the ice.

12 Claims, 1 Drawing Sheet

BALL FOR USE IN OFF-ICE HOCKEY TRAINING ON THE STREET

This application is based on provisional patent application 60/121,368, filed Feb. 25, 2000.

BACKGROUND OF THE INVENTION

1. Field of the Invention

This invention relates to objects such as hockey pucks and the like for use in games on hard surfaces, such as roadways and sidewalks, to methods for making the same, and to games played therewith.

2. The State of the Art

A typical hockey puck used on ice has the geometry of a circular disk, about one inch thick and about three inches in diameter, and is made of a hard rubber. When used on ice, the puck has tendency to slide on one of the disk faces, even when the puck starts out rolling on the edge of the disk.

Hockey is also played on hard, non-ice surfaces, such as streets and roadways. When a conventional hockey puck is used on such a hard surface, the friction of the surface (greater than that of ice) tends to allow a rolling puck to roll. Further, the friction of such hard surfaces is typically so great that a puck will not slide very far on one of the disk faces, generally not sufficiently far to be used in a hockey game, and never as far as would be expected playing on ice. Additionally, a conventional hockey puck has a tendency to bounce when used on such hard surfaces.

Conventional hockey balls (plastic spherical pucks) are too light in weight and too soft to provide the desired feel and action akin to ice hockey. In addition, such spherical pucks do not roll well if it becomes very warm (because of the increase in adhesion and/or tackiness of the plastic material).

Accordingly, there is a need for a puck or simulated puck that can be used on hard surfaces such as roadways and sidewalks and that will have the feel and action similar to that of a conventional hockey puck used on ice.

SUMMARY OF THE INVENTION

The primary object of this invention is to provide a device that simulates the feel and action of a real hockey puck, as if the user were playing with a conventional puck on ice. Such a device is useful not only for playing hockey off-ice but also for off-ice stick and puck training.

In summary, this invention provides a play item, in a geometry such as a sphere, comprising a hard coating surrounding a hard elastomer having reduced bounce.

More particularly, in a preferred embodiment the device is a spherical puck, having a diameter of about two inches, and comprising a urethane core and an ionmeric coating.

DESCRIPTION OF SPECIFIC EMBODIMENTS

Figure 1:
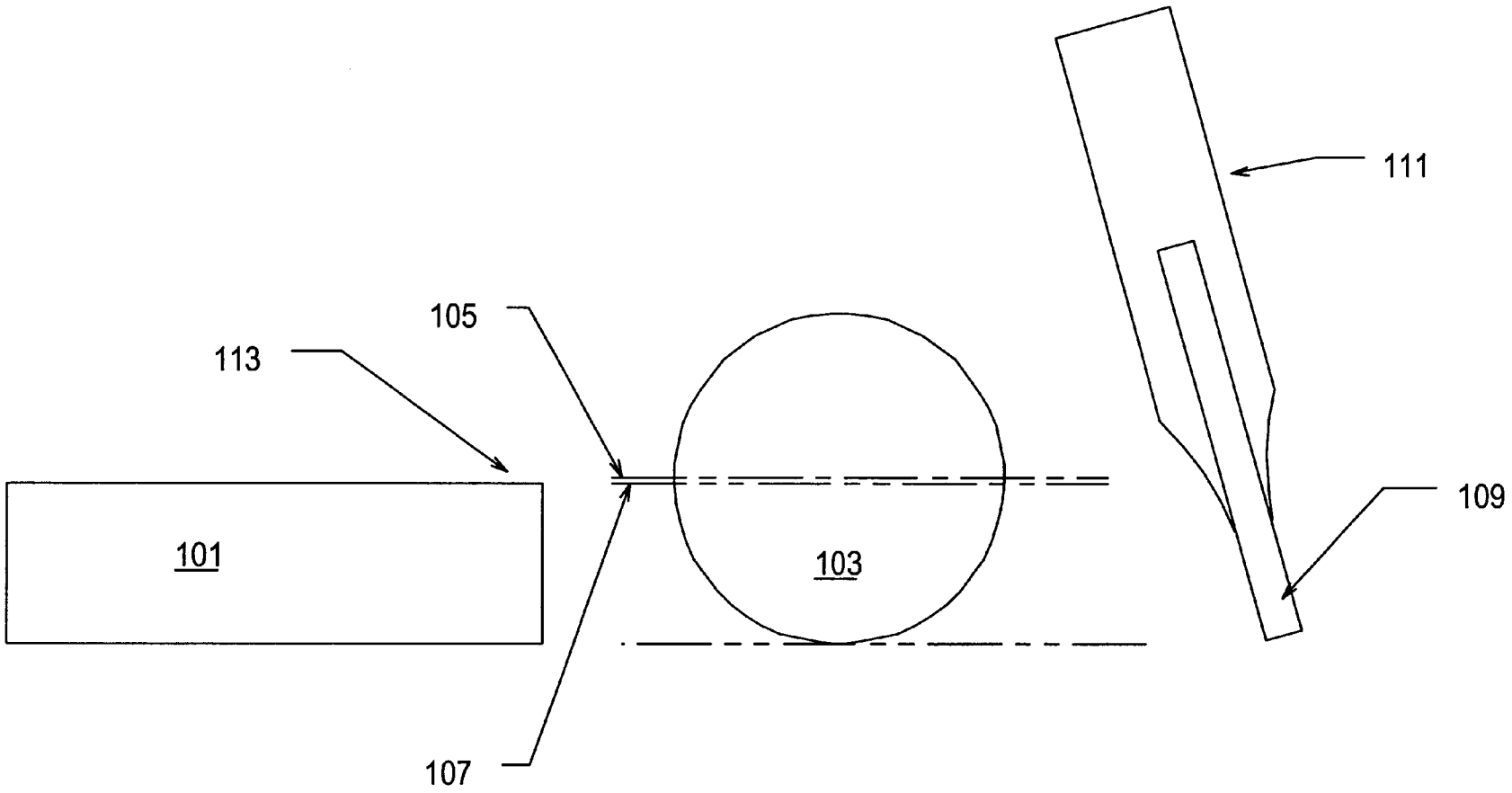
FIG. 1 provides an idealized side view showing the approximate size relationship among a conventional hockey puck, a hockey ball according to this invention, and the blade of a hockey stick.

The present invention is most preferably embodied as a sphere having a diameter of about two inches, more preferably having a diameter of about 2 1/32 to 2 1/16 inches. At this diameter, the widest part of the sphere (i.e., a diameter through the center) lies at about 1 inch from the ground, the same height as a conventional hockey puck.

With reference to FIG. 1, a conventional hockey puck 101 is shown from the side. Next to the conventional puck is a spherical puck 103 according to this invention. The diameter of the novel puck 105 is the same height as, or slightly higher than, the height 107 of a conventional hockey puck. When the blade 109 of a hockey stick 111 contacts a conventional hockey puck, the contact typically occurs at the upper edge 113. The widest part of the inventive puck is essentially the same height as the contact edge 113 of a conventional puck in order for the stick blade to contact the ball in essentially the same location. As shown in the figure, the widest part of the ball 105 is the same height as, or slightly higher than, the height 107 of the conventional puck.

The weight of the preferred embodiment of the spherical puck is about 5.9 ounces, the weight of a conventional hockey puck, and preferably is about 5.9±4 oz.; one-half pound is about the heaviest desirable for a puck, although significantly lighter weights (such as 2–3 oz.) can also be useful. The weight can be adjusted as desired; for example, one may prefer a heavier puck if the surface is rougher, and a lighter puck if the surface is smoother. The weight of the puck can be varied by changing the size of the puck, the materials of the puck (although most polymers have about the same density), and/or the parts of the puck (e.g., a puck with heavy core and one or more polymeric outer shells).

The puck is made preferably of two materials, a core comprising an elastic material with minimal rebound and a coating comprising a flexible, hard, and durable material. The core is called a green ball, as it is not a fully completed article for use in street hockey. The green ball is then covered by the coating material to result in the finished product.

A preferred material for the core is a polymer, preferably a polyurethane or polyisocyanate such as VIBRATHANE® 8050 or ADIPRENE® LF 1950A cured with VIBRACURE® A931. VIBRATHANE®, VIBRACURE®, and ADIPRENE® polymers are commercially available from Uniroyal Chemical (Middlebury, Conn.) and are the reaction product of an isocyanate (e.g., toluene diisocyanate, TDI) with a polyether or polyester. Other suitable durable polyurethanes are described by Gajewski and Gajewski et al. (U.S. Pat. Nos. 4,195,150, 5,023,040, 5,223,599, and 5,654,390), O'Donnell et al. (U.S. Pat. No. 5,112,933), Karoly et al. (U.S. Pat. No. 4,166,042), and Chin et al. (U.S. Pat. No. 5,714,561), the disclosures of which are incorporated herein by reference. The VIBRACURE® A931 curative is a polyol amine curative (e.g., containing phenyl diethanolamine) useful for curing polyether and polyester prepolymers (e.g., VIBRATHANE® B-896 (mixture of 2,4- and 2,6-toluene diisocyanate with polyether), VIBRATHANE® 8050, ADIPRENE® LF 1950A (mixture of 2,4- and 2,6-toluene diisocyanate with polyester)). Other suitable curatives include 4,4'-methylene-bis-(o-choroaniline) (called MBCA), and diamines, especially aromatic amines available under the trademarks ETHACURE® 100 (diethyl-2,4- and diethyl-2,6-toluenediamide), ETHACURE® 300 (di(methylthio)-2,4- and di(methylthio)-2,6-toluenediamine), and ETHACURE® 400 (blend of ETHACURE® 300 and a diol). Especially preferred compositions include VIBRATHANE® B896 cured with VIBRATHANE® A195 (a mixture or blend of VIBRATHANE® A931, ETHACURE® 100, and ETHACURE® 300), and ADIPRENE® LF 1950A cured with VIBRATHANE® A195 at a 90% stoichoimetric ratio. Polymeric compositions made with a polyester are harder than those made with a polyether.

The inventive puck of this invention is preferably non-bouncing to avoid the bouncing on the play surface and thus not behaving as a puck would on ice. "Ball rebound" is one indication of ball's bounciness and can be determined by testing according to ASTM D3574. This test involves dropping a steel ball of known mass from a predetermined height onto a sample of the material and the ball rebound height is expressed as a percentage of the original drop height. The lower the ball rebound height is expressed as a percentage of the original drop height. The lower the ball rebound number the more preferred for this invention; i.e., the "deader" the ball the better. The rebound is preferably less than 13%. A preferred rule of thumb is that the puck according to this invention should have essentially no bounce (preferably ≦5") when dropped from waist high, or about 3½ feet. VIBRATHANE 8050 cured with ETHACURE 300 has a Shore D hardness of about 50 and a Bashore Rebound of about 25–30%.

If a coating material is used, preferably it is comprised of a tough, flexible, smooth material, such as CAPRON nylon (e.g., ULTRATOUGH™ BU50I, available from Allied Signal, Morristown, N.J.), SURLYN ionomer, and the like as are typically used for coverings for golf balls. The coating for this invention may have a smooth surface (i.e., without dimples) or may have dimples regularly spaced on the surface.

It is also possible to make a puck according to this invention without a covering if the bulk puck material is tough. One purpose of the aforementioned coating is to prevent the stick blade from sticking to the puck due to inherent tackiness of the polymeric material, which is likely to change as the ambient temperature increases; for example, a puck used outdoors in Tucson or Houston is likely to be much tackier than the same puck used in New York or Boston because of the warmer ambient temperature (polymers typically become tackier as the temperature increases). Thus, a tough and hard material, that has some elastic character is useful for this invention. The present puck can be constructed somewhat like a bowling ball, which has a hard and smooth exterior, but bounces too much to be useful for this invention; further, bowling balls tend to chip, which would greatly diminish the utility of the present novel puck.

As described, this invention includes a play device, preferably in the geometry of a sphere or disk, that has minimal bounce and a smooth and hard or tough outer surface, and most preferably a dead core and a hard surface. As such, when this device is used, for example, for street hockey, the device rolls very quickly because of the hard coating. Also, the device has a significantly reduced tendency to bounce because of the dead center having a reduced ball rebound. In essence, then, when struck, this device will tend to roll very quickly without bouncing, analogous to a hockey puck played with on ice. The hard coating and low rebound material provide a device that does not deform or warp.

While this invention has been described with reference to street hockey, the puck may be disk shaped and used in that game, or may be spherical and used in a game such as field hockey.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A street hockey ball comprising a core and a covering thereon, said core comprising an elastic material having a low rebound, and said covering comprising a tough, hard material, said ball having the approximate weight of an ice hockey puck, the diameter of the ball being about two inches.

2. The street hockey ball according to claim 1, wherein the core comprises a polyurethane having a ball rebound of less than about 13%.

3. The street hockey ball according to claim 1, wherein the ball bounces less than about 5 inches after having been dropped from a height of about 3½ feet.

4. The street hockey ball according to claim 1, wherein the weight of the ball is 5.9±3 ounces.

5. The street hockey ball according to claim 4, wherein the weight of the ball is 5.9±1 ounces.

6. The street hockey ball according to claim 1, wherein the surface of the ball is dimpled.

7. A method for making a street hockey ball, comprising providing a low rebound flexible polymeric material, molding said polymeric material into a green ball, and covering said green ball with a tough material adhered to the polymeric material, the ball having a diameter of about two inches and a weight approximating that of an ice hockey puck.

8. The method of claim 7, further comprising covering said green ball with a tough, dimpled material.

9. A method of playing the game of hockey played off-ice, the improvement comprising playing the game with the street hockey ball according to claim 1.

10. A play device for simulating an ice hockey puck, comprising the geometry of a sphere, a hard outer surface, minimal bounce, a weight of about 5.9±3 ounces, and when disposed on a horizontal surface having its widest dimension disposed about one inch from said surface.

11. The play device of claim 10, wherein the weight is about 5.9±1 ounces.

12. A method of playing the game of hockey played off-ice, the improvement comprising playing the game with the device according to claim 10.

* * * * *